US009161577B1

(12) United States Patent
Harper

(10) Patent No.: US 9,161,577 B1
(45) Date of Patent: Oct. 20, 2015

(54) INFLATABLE UNDERGARMENT

(76) Inventor: Jonathan R. Harper, Springfield, TN (US)

( * ) Notice: Subject to any disclaimer, the term of this patent is extended or adjusted under 35 U.S.C. 154(b) by 0 days.

(21) Appl. No.: 13/617,887

(22) Filed: Sep. 14, 2012

Related U.S. Application Data

(60) Provisional application No. 61/535,037, filed on Sep. 15, 2011.

(51) Int. Cl.
*A41D 7/00* (2006.01)
*A41D 13/015* (2006.01)

(52) U.S. Cl.
CPC ..... *A41D 7/003* (2013.01); *A41D 13/0155* (2013.01)

(58) Field of Classification Search
CPC . A41D 7/003; A41D 13/018; A41D 13/0155; Y10S 2/03
USPC ..... 2/400–404, DIG. 3, 67, 467; 441/102
See application file for complete search history.

(56) References Cited

U.S. PATENT DOCUMENTS

| | | | | | |
|---|---|---|---|---|---|
| 1,468,072 | A | * | 9/1923 | Ogle | 128/889 |
| 1,691,658 | A | * | 11/1928 | Kennedy | 602/70 |
| 1,803,898 | A | * | 5/1931 | Diamond | 441/102 |
| 1,830,572 | A | * | 11/1931 | Taylor | 602/72 |
| 1,854,378 | A | * | 4/1932 | Mattson | 441/113 |
| 2,197,228 | A | * | 4/1940 | Then | 441/102 |
| 2,446,006 | A | * | 7/1948 | Hendricks | 2/467 |
| 2,524,212 | A | * | 10/1950 | Spack | 441/120 |
| 2,741,769 | A | * | 4/1956 | White | 450/38 |
| 2,807,805 | A | * | 10/1957 | Allan | 2/404 |
| 2,826,202 | A | * | 3/1958 | Star | 450/38 |
| 3,008,214 | A | * | 11/1961 | Foster et al. | 428/12 |
| 3,043,292 | A | * | 7/1962 | Mendelson | 601/44 |
| 3,049,736 | A | * | 8/1962 | Toulmin, Jr. | 441/113 |
| 3,098,248 | A | * | 7/1963 | Geier | 441/120 |
| 3,134,993 | A | * | 6/1964 | McCoy | 441/102 |
| 3,326,218 | A | * | 6/1967 | McAlpine | 450/38 |
| 3,665,517 | A | * | 5/1972 | Hyman | 2/84 |
| 3,838,471 | A | * | 10/1974 | Brolli | 441/115 |
| 3,883,053 | A | * | 5/1975 | Pritchard et al. | 224/264 |
| 4,370,755 | A | * | 2/1983 | Crumby | 2/88 |
| 4,737,994 | A | * | 4/1988 | Galton | 2/465 |
| 4,969,216 | A | * | 11/1990 | Guelli | 2/400 |
| 5,079,778 | A | * | 1/1992 | Sloot | 2/69 |
| 5,113,599 | A | * | 5/1992 | Cohen et al. | 36/88 |
| 5,500,952 | A | * | 3/1996 | Keyes | 2/465 |
| 5,502,842 | A | * | 4/1996 | Wagner | 2/67 |
| 5,833,515 | A | * | 11/1998 | Shahbazian et al. | 450/38 |
| 6,112,327 | A | * | 9/2000 | Shaffer | 2/67 |
| 6,231,411 | B1 | * | 5/2001 | Vinay | 441/120 |
| 6,564,387 | B1 | | 5/2003 | Willoughby | |
| 6,676,467 | B1 | * | 1/2004 | Filsouf | 441/90 |
| 6,859,948 | B2 | * | 3/2005 | Melts | 2/465 |
| 7,017,195 | B2 | * | 3/2006 | Buckman et al. | 2/455 |
| 8,104,096 | B1 | * | 1/2012 | Jenney | 2/67 |
| 8,398,574 | B1 | * | 3/2013 | Wiens | 602/68 |
| 2006/0150321 | A1 | * | 7/2006 | Brockman et al. | 5/81.1 R |
| 2008/0307557 | A1 | | 12/2008 | Bowen et al. | |

* cited by examiner

*Primary Examiner* — Richale Quinn
(74) *Attorney, Agent, or Firm* — Patterson Intellectual Property Law, P.C.; Timothy L. Capria

(57) ABSTRACT

Inflatable undergarment with an inflatable bladder to provide protection and comfort has a fabric garment portion. A rear area of the undergarment further includes an integral air bladder. The bladder covers the buttocks area and is selectively inflated using a manual pump located near the waistband of the undergarment. The bladder system further includes a release valve that allows air to be released from the device.

6 Claims, 4 Drawing Sheets

INFLATABLE UNDERGARMENT

RELATED APPLICATIONS

The present invention was first described in and claims the benefit of U.S. Provisional Application No. 61/535,037, filed Sep. 15, 2011, the entire disclosures of which are incorporated herein by reference.

FIELD OF THE INVENTION

The presently disclosed subject matter generally relates to an inflatable cushioning feature for an undergarment.

BACKGROUND OF THE INVENTION

The invention described herein pertains to underwear, and more specifically to underwear having an inflatable cushion attached thereto. Often, while attending sporting events, performing their jobs, attending classes, etc., people are forced to sit on hard surfaces for extended periods of time. Sitting on such surface can become uncomfortable after just a short period of time, and can exacerbate the pain and discomfort often associated with ailments such as hemorrhoids, back pain, nerve pain and the like. Although clothing provides a barrier between the user and the hard surface, common clothing does not provide enough cushion to alleviate the discomforts already mentioned.

There are various devices which attempt to address the discomfort many feel while sitting for extended periods of time. One (1) attempt is seen in U.S. Pat. No. 1,468,072 to Hubert Millas Ogle which describes an inflatable pad which can be hung from the waistband of an article of clothing. A tube which extends from the pad to the chest of the wearer is provided for inflating the device. The straps from which the device hangs not only pull at the users clothing in two (2) concentrated areas, but also fail to keep the device in a convenient location. Upon sitting, the wearer must reach in their pants and adjust the location of the pad, then they must take the extended tube and breath into it, causing inflation.

Another attempt to provide additional padding to an article of clothing is seen in U.S. Pat. No. 3,665,517 to Sam M. Hyman. This patent describes a one piece cold weather garment having inflatable cushions extending from the lower back to mid-thigh. The padding is designed to create a temperature barrier between the wearer and the cold exterior temperatures. A length of tubing extends from the cushions through an opening in the suit, and terminates in a pump which can be kept in a pocket on the garment. Similar to Ogle, this patent requires the wearer to carry an extended length of tubing outside their clothing, and also requires a hand pump which must be kept in the wearer's pocket.

Although the various devices observed may fulfill their individual, particular objectives, each device suffers from one (1) or more disadvantage or deficiency related to design or function. Whether taken singly, or in combination, none of the observed devices disclose the specific arrangement and construction of the instant invention.

SUMMARY OF THE INVENTION

The inventor has recognized the deficiencies in the art pertaining to integral garment padding. Furthermore, the inventor has observed that there is a need for a garment which can provide padding to a user while not being difficult to use or cumbersome to carry.

The inventor has addressed at least one (1) of the problems observed in the art by developing a novel inflatable undergarment. It is a feature and aspect of the present invention to provide an undergarment with inflatable padding having inflating tubing coupled to an inflating button and release tubing coupled to a release button. The inflating button and release button are secured to the waistband of the undergarment and the entire apparatus remains covered by outer garments.

Another feature of the invention is to provide inflatable padding having a padding gap disposed thereon. The padding gap being strategically placed to accommodate conditions such as, but not limited to, hemorrhoids or topical skin anomalies. In an additional embodiment, the invention provides inflatable padding which extends from the buttocks of the user to cover the crotch and the front pelvic areas of the user.

Yet another feature of the invention is to provide inflatable padding which can be integrated into an undergarment during manufacture, or securely attached to an existing undergarment.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawing and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
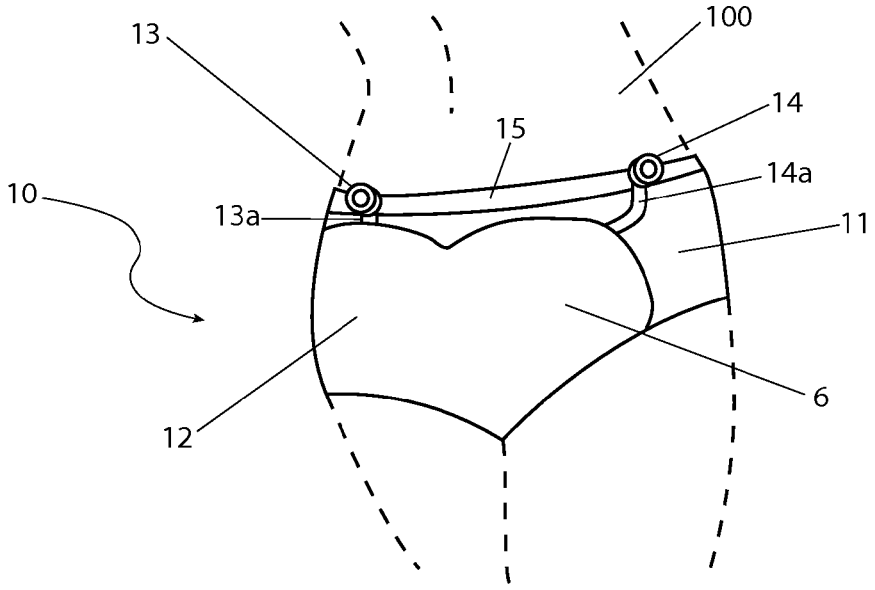
FIG. 1 is a perspective view of an inflatable undergarment 10, according to a preferred embodiment.

5 crotch area
6 rear side
7 pelvic area
10 inflatable undergarment
11 undergarment
12 inflatable padding
13 inflating button
13*a* inflating tubing
14 release button
14*a* release tubing
15 waistband

20 first alternate inflatable undergarment
21 first alternate undergarment
22 first alternate inflatable padding
22*a* padding gap
30 second alternate inflatable undergarment
31 second alternate undergarment
32 second alternate inflatable padding
100 user

DETAILED DESCRIPTION OF THE PREFERRED EMBODIMENT

Figure 2:
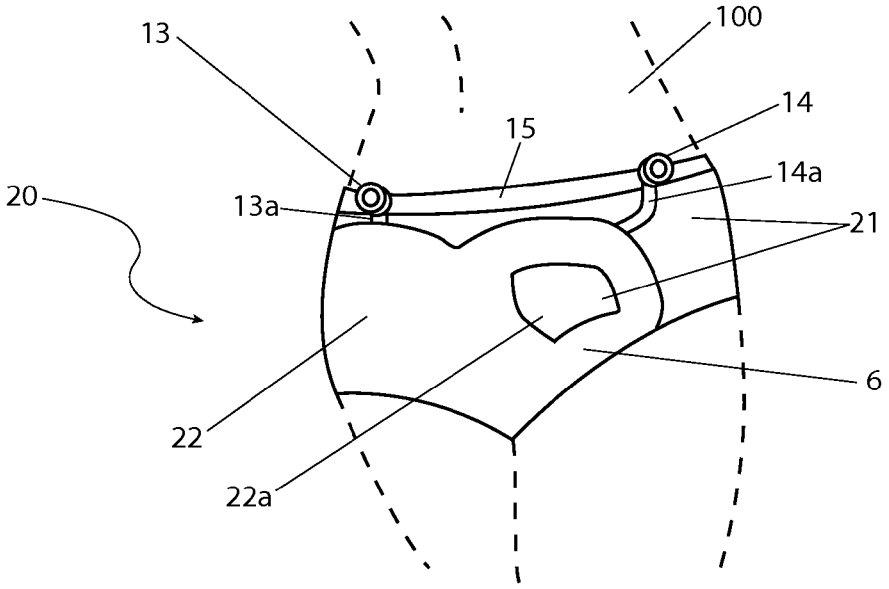
FIG. 2 is a perspective view of a first alternate inflatable undergarment 20, according to a first alternate embodiment.
Figure 3:
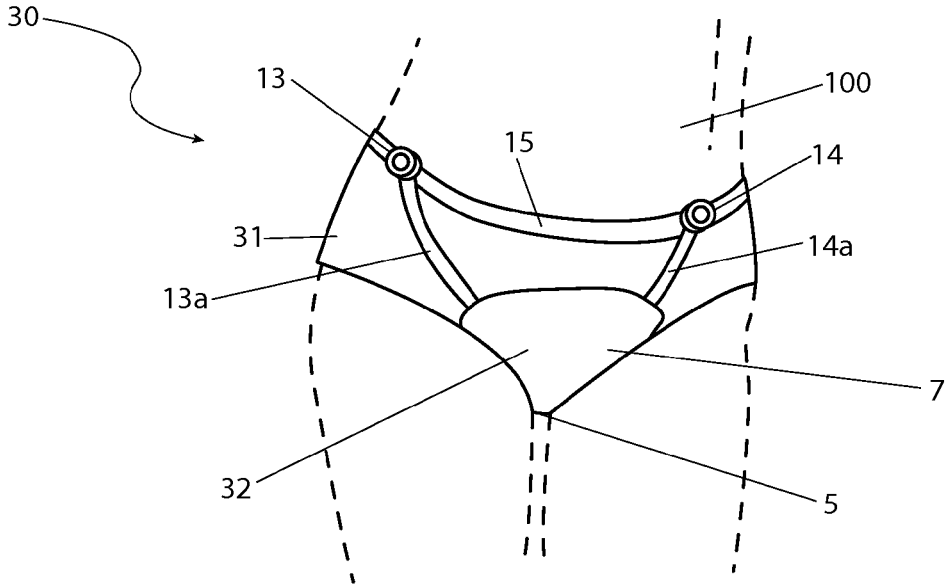
FIG. 3 is a front perspective view of a second alternate inflatable undergarment 30, according to a second alternate embodiment.
Figure 4:
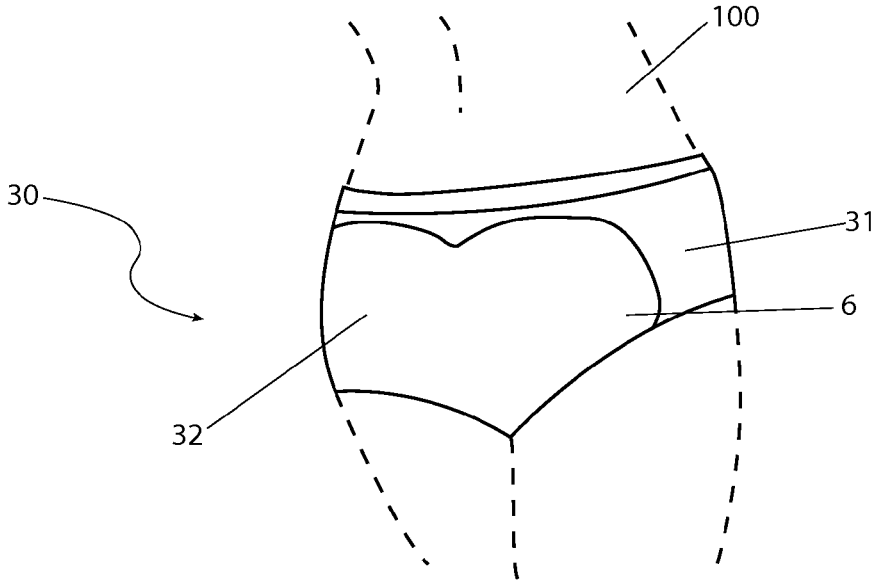
FIG. 4 is a rear perspective view of the second alternate inflatable undergarment 30, according to the second alternate embodiment

The best mode for carrying out the invention is presented in terms of its preferred embodiment, herein depicted within FIG. 1, and in terms of alternate embodiments, herein depicted within FIGS. 2 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an inflatable undergarment (herein referred to as an "apparatus") 10 being designed to provide a user 100 with selectable comfort and padding while seated for prolonged periods. The apparatus 10 can provide padding to a user's 100 buttock area 6. Selective comfort is accomplished using an inflatable padding portion 12 which may be inflated or deflated according to the user's 100 preference.

Referring now to FIG. 1, a perspective view of the apparatus 10 is disclosed. The apparatus 10 comprises a fabric lower-torso undergarment 11 with an inflatable padding portion 12 being integral to the undergarment 11. The fabric undergarment 11 is preferably worn over an existing conventional undergarment and underneath the user's 100 exterior clothing.

The inflatable padding 12 is constructed of an air-tight plastic film vessel being permanently affixed along one (1) side surface to the undergarment 11 using adhesives or equivalent fabric bonding methods. The inflatable padding 12 can be selectively inflated or deflated by a user 100 using an inflating button 13 or a release button 14, respectively, which are affixed along a top edge of the undergarment 11 such as the waistband 15. The inflatable padding 12 is to cover the entire buttocks area 6 of the user 100. Furthermore, the undergarment 11 is envisioned to comprise a sewn-in double-layer fabric to provide an aesthetic appearance.

Figure 5:
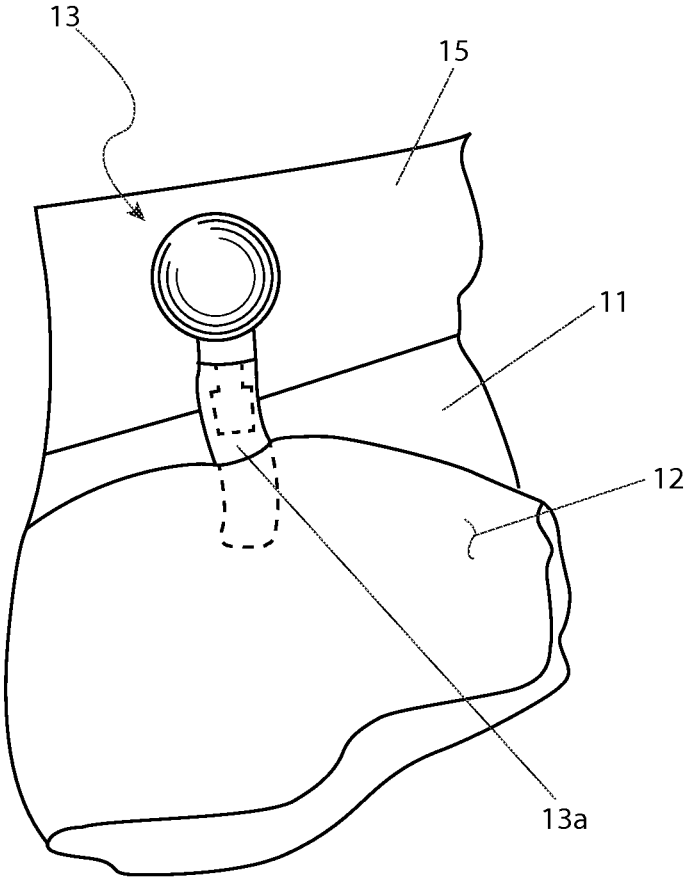
FIG. 5 is a close-up view of a hemispherical pump and check valve embodiment of the inflating button 13, according to the second alternate embodiment; and, FIG. 6 is a close-up view of a poppet check valve embodiment of the release button 14.

The inflating button 13 and release button 14 are preferably affixed along opposing waistband portions of the undergarment 11 such that the buttons 13, 14 are readily distinguishable and unobtrusive. The inflating button 13 is in fluid communication with an interior space of the padding 12 via a length of inflating tubing 13*a* being integral to the undergarment 11. The inflating button 13 is envisioned to comprise a hemispherical pump and check valve mechanism similar to U.S. Pat. No. 5,113,599, or an equivalent mechanism, which introduces a small volume of air into the padding 12 via the inflating tubing 13*a* every time it is pressed (please see FIG. 5).

Figure 6:
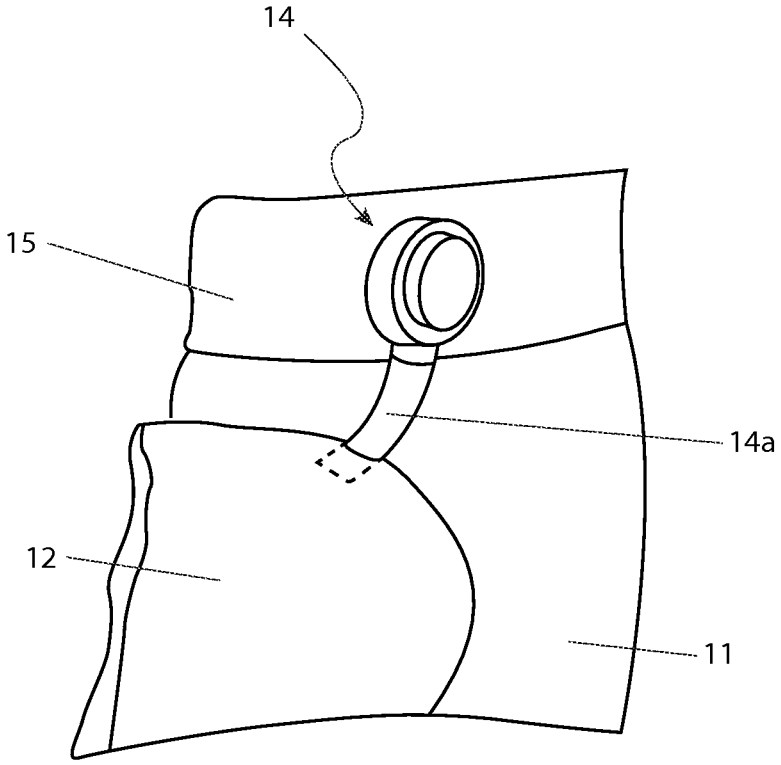

The deflating button 14 is also in fluid communication with an interior space of the padding 12 via a length of deflating tubing 14*a* being integral to the undergarment 11. The deflating button 14 comprises a mechanism that allows air to escape from the padding 12 into the atmosphere via the deflating tubing 14*a* as long as the deflating button 14 is pressed, but which retains air within the padding 12 when not pressed. Said deflating button 14 is envisioned to comprise a poppet-type check valve or equivalent air releasing mechanism (please see FIG. 6).

Referring now to FIG. 2, a perspective view of a first alternate apparatus 20 is disclosed. The first alternate apparatus 20 comprises a first alternate fabric undergarment 21, a first alternate inflatable padding 22, and at least one (1) padding gap 22*a*. The first alternate apparatus 20 comprises similar construction and purpose as the preferred fabric undergarment 11; however, the padding gap portion 22*a* of the first alternate apparatus 20 provides an open relieved area within the first alternate padding 22. The padding gap 22*a* can be manufactured to correspond in size and shape to a desired area 6 on a user's 100 buttocks in order to accommodate a condition such as a hemorrhoid, topical skin anomaly, or the like. In this manner, the first alternate apparatus 20 can provide a function similar to a donut cushion device while providing the same features as the previously described preferred apparatus 10. It is envisioned that the first alternate apparatus 20 may also comprise a plurality of padding gaps 22*a* which may take on various shapes and corresponding sizes to suit various conditions, and as such should not be interpreted as a limiting factor of the apparatus 10.

Referring now to FIGS. 3 and 4, front and rear perspective views of a second alternate apparatus 30 are disclosed. The second alternate apparatus 30 comprises a second alternate fabric undergarment 31 further comprising a second alternate inflatable padding 32*d*.

The second alternate inflatable padding 32 provides similar construction and purpose as the preferred fabric undergarment 11 while further comprising a shape which covers the rear buttocks 6, the crotch 5, and the front pelvic areas 7 of the user 100. The alternate inflatable padding 32 is a single unitary sealed vessel that extends across the bottom of the second alternate undergarment 31, enabling both sides of the second alternate padding 32 to be inflated and deflated simultaneously using the inflating button 13 and release button 14 portions, respectively.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the preferred apparatus 10 may be achieved by performing the following steps: procuring a model of the apparatus 10 having a desired size, design, and construction; donning the undergarment 11 over top of an existing undergarment; donning external clothing such as pants or another article of lower-torso clothing to conceal the apparatus 10; repeatedly pressing upon the inflating button 13 in order to create a desired amount of air pressure within the padding 12; and, benefiting from sitting comfortably upon the padding 12 for a prolonged period of time afforded a user of the present invention 10.

The amount of support provided by the padding 12 may be quickly and selectively varied by either introducing additional air within, by repeatedly pressing the inflating button 13 or by removing a portion of contained air by pressing the deflating button 14 in order to fine-tune the level of support, based upon a user's preference, to accommodate for changing conditions, or to replace leaked air. It is understood that the user 100 may completely deflate the padding 12 prior to standing up or walking, such that the apparatus 10 is less visible, if desired. When deflated and removed from a user's bodice, the apparatus 10 is easily folded for compact transportation or storage.

The first alternate apparatus 20 can be utilized in a similar manner to the preferred apparatus 10 while further enabling the user 100 to avoid the aggravation of a current condition such as a hemorrhoid, topical skin anomaly, or the like, by aligning a padding gap portion 22*a* with said condition during use and thereby providing a function similar to a hemorrhoid donut device. The second alternate apparatus 30 can be utilized in a similar manner to the apparatus 10 while also providing padding to a user's 100 front pelvic area.

The apparatus 10, and by extension the alternate apparatuses 20, 30, are intended to provide various benefits to a user over existing methods of padding a user's 100 buttock area 6 during periods of prolonged sitting. The apparatus 10 can be dynamically customized by the user 100 based upon preference and conditions in order to provide maximum comfort using the inflating button 13 and release button 14 portions. The apparatus 10 can be utilized with existing garments. The apparatus 10 is simple to utilize and does not require large amounts of time, coordination, or physical strength to operate. The apparatus 10 can be operated while being worn under existing clothing. The apparatus 10 can be deflated during times in which the user 100 is not seated such that the apparatus 10 is less visible or bulky.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An undergarment, comprising:

a fabric body comprising a waistband portion of an upper perimeter of said body, a pair of leg openings, and a rear side;

an inflatable portion removably affixed to the rear side of said fabric body, the inflatable portion including an air-tight plastic film vessel;

an inflating pump located on said fabric body in fluid communication with an interior of said inflatable portion; and, a deflating valve located on said fabric body in fluid communication with said interior of said inflatable portion;

wherein said inflating pump and deflating valve are separate from and located remotely from each other;

wherein said inflatable portion is selectively inflated or deflated using said inflating pump or said deflating valve, respectively; and further wherein said inflatable portion is affixed to the rear side, a crotch area, and a front pelvic area of said fabric body.

2. The undergarment of claim 1, wherein said inflating pump and said deflating valve each further comprise a button.

3. The undergarment of claim 2, wherein said inflating pump and said deflating valve are each located on said waistband.

4. The undergarment of claim 3, wherein said inflating pump is a hemispherical pump and check valve mechanism.

5. The undergarment of claim 3, wherein said deflating valve is a poppet check valve.

6. An undergarment, comprising:

a fabric body, comprising a waistband portion of an upper perimeter of said body, a pair of leg openings, and a rear side;

an inflatable portion removably affixed to the rear side of said fabric body, said inflatable portion further comprising an air-tight plastic film vessel;

at least one gap of said inflatable portion;

a hemispherical pump and check valve mechanism located on said fabric body in fluid communication with an interior of said inflatable portion; and, a deflating poppet check valve located on said fabric body in fluid communication with said interior of said inflatable portion and wherein said inflating pump and said deflating poppet check valve are each located on said waistband;

wherein said hemispherical pump and check valve mechanism and deflating poppet check valve are separate from and located remotely from each other;

wherein said inflatable portion is selectively inflated or deflated using said hemispherical pump and check valve mechanism or said deflating poppet check valve, respectively;

wherein said at least one gap is located at a selective location of said inflatable portion adapted to encompass a skin anomaly of a user;

wherein said hemispherical pump and check valve mechanism and said poppet check deflating valve each further comprise a button; and wherein said inflatable portion is affixed to the rear side, a crotch area, and a front pelvic area of said fabric body.

* * * * *